United States Patent [19]

Inoue et al.

[11] 4,436,482

[45] Mar. 13, 1984

[54] CONSTANT SHIP SPEED CONTROL METHOD

[75] Inventors: Morio Inoue, Yokohama; Satoshi Hoshino, Tokyo; Hideki Namura, Yokohama; Takashi Watari, Kamakura, all of Japan

[73] Assignee: Nippon Kokan Kabushiki Kaisha, Tokyo, Japan

[21] Appl. No.: 303,021

[22] Filed: Sep. 17, 1981

[30] Foreign Application Priority Data

Sep. 19, 1980 [JP] Japan ..... 55-129198

[51] Int. Cl.[3] ..... B63H 3/10

[52] U.S. Cl. ..... 416/1; 416/27

[58] Field of Search ..... 416/1, 25, 27, 35, 43

[56] References Cited

U.S. PATENT DOCUMENTS

| | | | |
|---|---|---|---|
| 2,588,371 | 3/1952 | Englesson | 416/27 |
| 2,958,381 | 11/1960 | Stevens et al. | 416/27 |
| 3,088,523 | 5/1963 | Smalley et al. | 416/1 |
| 3,110,348 | 11/1963 | Greiner | 416/27 |
| 3,588,272 | 6/1971 | Lindahl et al. | 416/1 |
| 3,589,830 | 6/1971 | Mogren et al. | 416/1 |
| 3,826,590 | 7/1974 | Kobelt | 416/27 |
| 4,142,829 | 3/1979 | Inoue et al. | 416/25 |
| 4,239,454 | 12/1980 | Olson | 416/27 |

FOREIGN PATENT DOCUMENTS

| | | | |
|---|---|---|---|
| 52-75792 | 6/1977 | Japan | 416/35 |
| 7900306 | 3/1980 | Netherlands | 416/43 |
| 851694 | 10/1960 | United Kingdom | 416/43 |
| 575268 | 10/1977 | U.S.S.R. | 416/27 |

*Primary Examiner*—Everette A. Powell, Jr.

*Attorney, Agent, or Firm*—Fleit, Jacobson, Cohn & Price

[57] ABSTRACT

A method of controlling the speed of a ship equipped with a controllable pitch propeller at a predetermined value. A desired horsepower corresponding to a desired ship speed is obtained in accordance with the actual horsepower, the detected ship speed value and the preset ship speed value, and the rpm of the main engine is controlled in accordance with the desired rpm obtained in accordance with a engine loading function generator for minimum fuel consumption obtained in accordance with predetermined engine loading function generator for optimum propeller efficiency and a designed load characteristic function and the desired horsepower. A desired fuel rack position is obtained in accordance with the desired rpm and the desired horsepower and the desired fuel rack position is compared with the actual fuel rack position so as to control the blade angle of the propeller. By thus controlling the main engine rpm and the propeller blade angle, it is possible to maintain the speed of the ship at the value preset in accordance with the running schedule for all the changes in the running conditions and it is also possible to ensure the minimum fuel consumption for the preset ship speed.

3 Claims, 4 Drawing Figures

CONSTANT SHIP SPEED CONTROL METHOD

BACKGROUND OF THE INVENTION

The present invention relates to a method of controlling the speed of a ship equipped with a controllable pitch propeller at a predetermined value.

As an example of the prior art methods for controlling the main engine and the controllable pitch propeller of controllable pitch propeller equipped ships, a method is known which is used with the automatic load control system generally abbreviated to ALC. The ALC system controls the blade angle of the controllable pitch propeller in such a manner that the hatched area in FIG. 1 becomes the operating region of the main engine. More specifically, the upper limit is defined by the main engine desired load characteristic designated at "a" in FIG. 1 and the lower limit is defined by the line "b" determined to provide a certain margin with respect to the characteristic "a", so that if the current operating condition goes beyond the upper limit (an overload condition) or the lower limit (a low load condition) due to the external conditions, the blade angle of the controllable pitch propeller is controlled so as to always maintain the operating condition within the hatched region.

Thus, there is a disadvantage that although the ALC system effectively utilizes the main engine output, no conideration is given to the propeller efficiency with the result that the optimum efficiency cannot be obtained and hence the minimum fuel consumption cannot be attained under the existing ship speed and external conditions.

Another method of maintaining the speed of a ship at a predetermined value is disclosed in the Japanese Laid-Open Patent Application Publication No. 52-22298 and this method does not clearly show the method of controlling the revolutions of the main engine.

SUMMARY OF THE INVENTION

It is the object of the present invention to provide a constant ship speed control method which overcomes the foregoing deficiencies in the prior art and which minimizes fuel consumption.

In other words in accordance with, the present invention, a desired horsepower corresponding to a desired ship speed is obtained in accordance with the actual horsepower, the detected ship speed value and the preset ship speed value; a desired rpm is derived in accordance with a minimum fuel characteristic function obtained in accordance with a predetermined engine loading function generator for obtaining optimum propeller efficiency, a ship load characteristic function, and the desired horsepower so as to control the main engine speed or rpm; and a desired fuel rack position is obtained in accordance with the desired rpm and the desired horsepower so as to compare it with the actual fuel rack position and thereby to control the propeller blade angle.

Other and further objects, features and advantages of the invention will appear more fully from the following description.

DESCRIPTION OF THE PREFERRED EMBODIMENT

Figure 2:
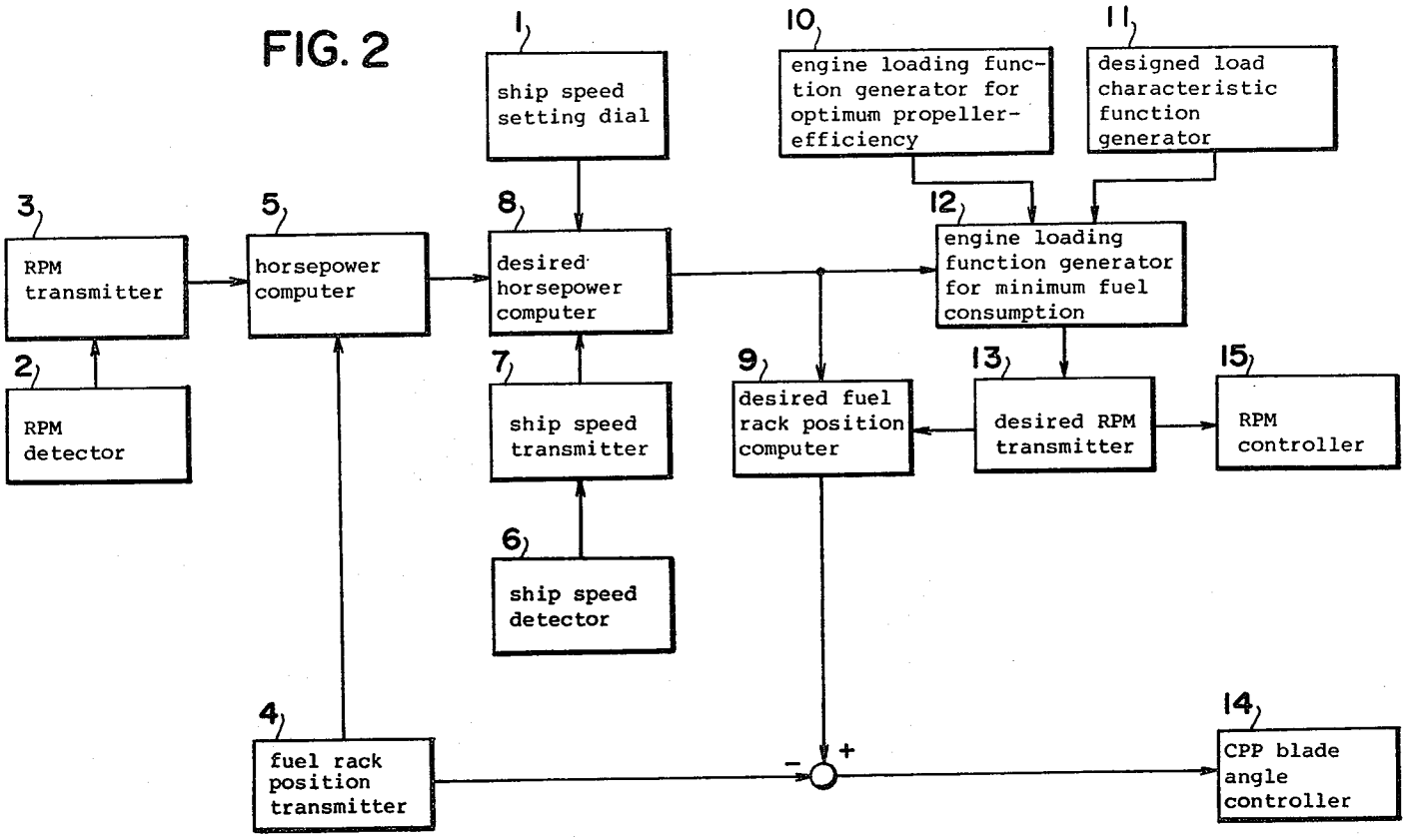
FIG. 2 is a block diagram showing a control system for performing a method according to the invention.

A preferred embodiment of the invention will now be described with reference to FIG. 2. A ship speed setting dial 1 is one for setting the then current desired ship speed. A rpm detector 2 is one for measuring the actual rpm of a propeller shaft, and a rpm transmitter 3 sends the rpm measured by the rpm detector 2. A fuel rack position transmitter 4 sends the actual fuel rack position. A horsepower computer 5 is responsive to the rpm signal from the rpm transmitter 3 and the fuel rack position signal from the fuel rack position transmitter 4 to compute the corresponding horsepower. A ship speed detector 6 measures the actual ship speed and it comprises an electromagnetic log or the like. A ship speed transmitter 7 sends the ship speed measured by the ship detector 6. A desired horsepower computer 8 is responsive to the horsepower and the ship speed respectively sent from the horsepower computer 5 and the ship speed transmitter 7 and the desired ship speed sent from the ship speed setting dial 1 to computer a desired horsepower in the manner which will be described later. A desired fuel rack position computer 9 is responsive to the desired horsepower from the desired horsepower computer 8 and the desired rpm from a desired rpm transmitter 13 which will be described later to compute a desired fuel rack position. An engine loading function generator for optimum propeller efficiency 10 is responsive to the ship speed presented by the ship speed setting dial 1 to determine the relation between the fuel rack position and the rpm which results in the optimum propeller efficiency in the manner which will be described later. A designed load characteristic function generator 11 is of the type which is used in the ordinary ALC system. A engine loading function generator for minimum fuel consumption 12 compares the functions from the engine loading function generator for optimum propeller efficiency 10 and the designed load characteristic function generator 11 such that the function from the desired load characteristic function generator 11 is used in the range where the function from the engine loading function generator for optimum propeller efficiency 10 results in a rich torque and the function from the engine loading function generator for optimum propeller efficiency 10 is used in the range where there is no possibility of resulting in the rich torque, thus generating a function in the manner which will be described later. The desired rpm transmitter 13 sends the desired rpm determined by engine loading function generator for minimum fuel consumption 12. A controllable pitch propeller blade angle controller 14 controls the blade angle of a controllable pitch propeller in such a manner that the actual fuel rack position becomes equal to the desired fuel rack position computed by the desired fuel rack position computer 9. A rpm controller 15 controls the rpm of the main engine to become equal to the desired rpm from the desired rpm transmitter 13.

The engine loading function generator for developing the optimum propeller efficiency 10 will now be described in a greater detail. Where the engine has a sufficient remaining power, a controllable pitch propeller blade angle and rpm are determined which minimize the required horsepower for the ship to run at a given speed. However, they are subject to variation depending on the loading condition of the ship, such as the wind and waves during the sea navigation, etc. As a result, the resistance of the ship, that is, the loading condition and the externally applied force due to the wind and waves are varied in many ways to obtain for each of the ship resistances the necessary rpm and controllable pitch propeller blade angle for minimizing the required horsepower to run the ship at the given speed. This relation is such that if the fuel rack position is given as a function of the rpm, then the controllable pitch propeller blade angle can be determined and controlled by the controllable pitch propeller blade angle controller 14. This function is preliminarily established for each of different ship speeds and the functional relation between the fuel rack position and the rpm corresponding to the ship speed preset by the ship speed setting dial 1 is obtained by interpolation. If the service speed is fixed, only one such function is necessary.

Figure 3:
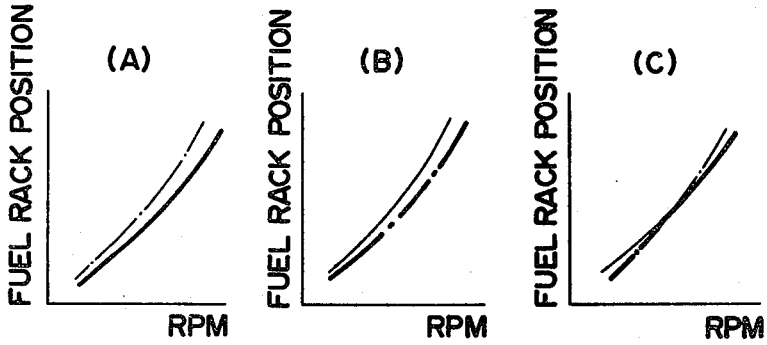
FIG. 3 shows in (A), (B) and (C) a plurality of different minimum fuel characteristic diagrams.

The engine loading function generator 12 for establishing minimum fuel consumption will now be described in greater detail with reference to FIG. 3. In the Figure, the solid lines represent an optimum propeller efficiency curve, the dot-and-dash lines represent a ship load characteristic curve and the thick lines represent a minimum fuel characteristic curve. FIG. 3(*a*) shows a case where the optimum propeller efficiency curve is below the ship load characteristic curve, that is, a case where there is no danger of causing an overload condition of the main engine within its entire rpm range even if the blade angle of the controllable pitch propeller is controlled in accordance with the optimum propeller efficiency curve. FIG. 3(*b*) shows a case where the optimum propeller efficiency curve is above the ship load characteristic curve so that there is the danger of causing an overload condition of the main engine throughout its rpm range if the controllable pitch propeller blade angle is controlled in accordance with the optimum propeller efficiency curve, thus making it possible only to control the blade angle in accordance with the ship load characteristic curve. FIG. 3(*c*) shows a case where the optimum propeller efficiency curve and the ship load characteristic cross each other so that while there is a certain range where the blade angle can be controlled in accordance with the optimum propeller efficiency curve, there is the danger of causing an overload condition of the main engine in the remaining range thus making it necessary to control the blade angle according to the ship load characteristic curve. In accordance with this function, the optimum rpm corresponding to the required preset horsepower for the preset ship speed can be selected thus rapidly eliminating the variation of the ship speed.

Figure 1:
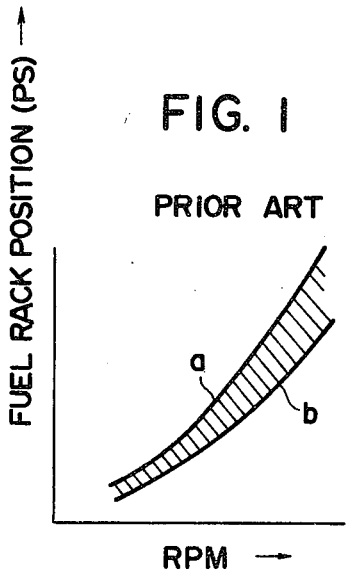
FIG. 1 PRIOR ART
FIG. 1 is a characteristic diagram showing the operating region according to the prior art ALC system.
Figure 4:
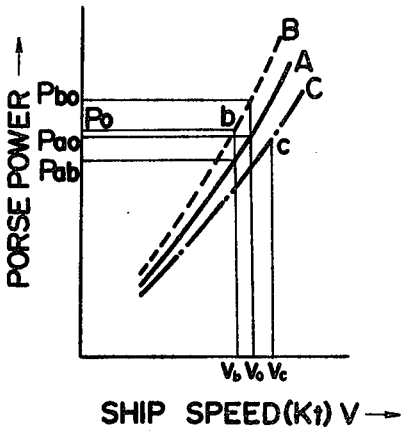
FIG. 4 is a characteristic diagram showing the relationship between the ship speed and the required horsepower.

The desired horsepower computer 8 will now be described in greater detail with reference to FIG. 4. In the Figure, the curve A shows the relation between the ship speed and the required horsepower under the normal loading condition of the ship and the normal sea weather condition. The curve A has been preliminarily stored in the desired horsepower computer 8. Then, the horsepower and the ship speed under the actual navigation condition are respectively received from the horsepower computer 5 and the ship speed transmitter 7. Here, the horsepower and the ship speed are respectively represented by Pb and Vb. This navigation condition is indicated at a point "b" in the Figure. The curve B shows the relation between the horsepower and the ship speed obtained on the basis of the point "b" under the current navigation condition. This is obtained in the following way.

Firstly, the relation between the ship speed and the horsepower is approximated to the relation of the following equation $$P=q\cdot V^{r} \tag{1}$$

More specifically, in accordance with the curve A the horsepowers Pab and Pao respectively corresponding to the ship speeds Vb and Vo are obtained from the stored relation between the horsepower and the ship speed and the obtained values are substituted in the equation (1) thus solving simultaneous equations and obtaining "q","r". These values are respectively represented by qa and ra.

Then the curve B is approximated as the following equation $$P=qb\cdot V^{ra} \tag{2}$$

The point "b" (Pb, Vb) is substituted in the equation (2) to obtain the value of qb. In this way, the curve B in the range of the ship speeds Vb to Vo can be satisfactorily approximated.

As a result, the horsepower Pbo required for the ship to run at the ship speed Vo under the then current navigation condition can be obtained from the equation (2). By sending the horsepower Pbo to the engine loading function generator for minimum fuel consumption 12, it is possible to accurately preset the required rpm.

In the Figure, the curve C shows the relation between the horsepower and the ship speed when the navigation condition is at a point C and this curve can be obtained in the similar manner as the above mentioned curve B.

The control method according to the preferred embodiment is performed by the above described control system which in turn operates as follows.

(1) The horsepower computer 5 computes the actual horsepower in accordance with the actual fuel rack position from the fuel rack position transmitter 4 and the engine rpm detected by the rpm detector 2 and received by way of the rpm transmitter 3.

(2) In accordance with this computation result (horsepower) and the actual ship speed detected by the ship speed detector 6 and received by way of the ship speed transmitter 7, the desired horsepower computer 8 computes the desired horsepower corresponding to the desired ship speed preset by the ship speed setting dial 1.

(3) In response to the desired horsepower, the optimum propeller efficiency function received from the engine loading function generator for optimum propeller efficiency 11 and the designed load caracteristic function received from the designed load characteristic function generator 11, the engine loading function generator for minimum fuel consumption 12 produces a desired rpm which in turn is applied to the desired rpm transmitter 13.

(4) The desired rpm transmitter 13 transmits the desired rpm to the rpm controller 15 which in turn controls the speed of the main engine.

(5) On the other hand, in response to the desired rpm from the desired rpm transmitter 13 and the desired horsepower from the desired horsepower computer 8, the desired fuel rack position computer 9 computes a desired fuel rack position and this fuel rack position is then compared with the actual fuel rack position from the fuel rack position transmitter 4, thus controlling the propeller blade angle through the controllable pitch propeller blade angle controller 14.

It will thus be seen from the foregoing that in accordance with the method of this invention the desired rpm of the main engine is obtained in accordance with the desired horsepower necessary for attaining the desired ship speed and the engine loading function for minimum fuel consumption derived in consideration of both the optimum propeller efficiency characteristic and the designed load characteristic, thus making it possible not only to maintain the actual ship speed at the desired ship speed but also to minimize the fuel consumption of the main engine.

What is claimed is:

1. A method for controlling the speed of a ship which includes a main engine for driving a main shaft at a given rpm, a fuel rack adapted to be positioned for setting the horsepower generated by the main engine, a controllable pitch propeller having a variable blade angle connected to the main shaft, and a ship speed detector, said method comprising the steps of:

determining the actual horsepower of the main engine in accordance with the main engine fuel rack position and the main shaft rpm;

determining a desired horsepower corresponding to a desired ship speed in accordance with the detected ship speed from the ship speed detector, the actual horsepower of the main engine, and a preset ship speed;

generating a first function of first fuel rack position and first main shaft rpm which provides an optimum propeller efficiency in accordance with said preset ship speed and generating a second function of a second fuel rack position and a second main shaft rpm;

comparing said first and second functions so as to define a range related to said second function where use of said first function results in a rich torque and a second range where use of said first function results in no rich torque, thereby generating a minimum fuel characteristic function;

determining a desired engine rpm in accordance with said minimum fuel characteristic function and said desired horsepower;

controlling the rpm of the main shaft in accordance with said desired rpm;

determining a desired fuel rack position in accordance with the desired rpm and said desired horsepower;

comparing said desired fuel rack position and the main engine fuel rack position to obtain a difference therebetween; and controlling the blade angle of the controllable pitch propeller in accordance with said difference thereby to attain efficiency in operation.

2. A method according to claim 1, wherein an approximate characteristic expression for the horsepower and ship speed under actual navigation condition is determined in accordance with a preliminarily memorized approximate characteristic expression for the ship speed and required horsepower under normal ship loading condition and normal weather condition, and wherein said desired horsepower corresponding to said preset ship speed value is derived in accordance with said determined approximate characteristic expression.

3. A method according to claim 1, wherein said engine loading function for optimum propeller efficiency and said designed load characteristic function are compared to select one of the same providing a smaller fuel rack position value for main engine revolutions and thereby to derive engine loading function for minimum fuel consumption.

* * * * *